US011333135B2

(12) United States Patent
Cornett et al.

(10) Patent No.: US 11,333,135 B2
(45) Date of Patent: May 17, 2022

(54) AXIAL PISTON MACHINE AND METHOD OF EXTENDING NEUTRAL POSITION FOR AXIAL PISTON MACHINE

(71) Applicant: Kanzaki Kokyukoki Mfg. Co., Ltd., Amagasaki (JP)

(72) Inventors: Timothy Scott Cornett, Morristown, TN (US); Stephen Galucki, Morristown, TN (US); Thomas Lakas, Morristown, TN (US)

(73) Assignee: Kanzaki Kokyukoki Mfg. Co., Ltd., Amagasaki (JP)

( * ) Notice: Subject to any disclaimer, the term of this patent is extended or adjusted under 35 U.S.C. 154(b) by 301 days.

(21) Appl. No.: 16/654,440

(22) Filed: Oct. 16, 2019

(65) Prior Publication Data

US 2020/0141395 A1 May 7, 2020

Related U.S. Application Data

(60) Provisional application No. 62/754,265, filed on Nov. 1, 2018.

(51) Int. Cl.

| | |
|---|---|
| ***F04B 1/2078*** | (2020.01) |
| ***F04B 39/02*** | (2006.01) |
| ***F04B 1/2035*** | (2020.01) |

(52) U.S. Cl.

CPC ..... *F04B 1/2078* (2013.01); *F04B 1/2035* (2013.01); *F04B 39/0292* (2013.01); *F04B 2201/0201* (2013.01)

(58) Field of Classification Search

CPC ..... F04B 1/34; F04B 1/2035; F04B 1/2078; F04B 39/0292; F04B 2201/0201; F03C 1/0636; F03C 1/0684

See application file for complete search history.

(56) References Cited

U.S. PATENT DOCUMENTS

| | | | | |
|---|---|---|---|---|
| 5,836,159 | A | 11/1998 | Shimizu et al. | |
| 6,109,032 | A | 8/2000 | Shimizu et al. | |
| 6,341,488 | B1 | 1/2002 | Shimizu et al. | |
| 6,349,544 | B1 | 2/2002 | Shimizu et al. | |
| 6,513,325 | B2 | 2/2003 | Shimizu et al. | |
| 2017/0037837 | A1* | 2/2017 | Funasaka | F04B 1/2078 |
| 2018/0142553 | A1* | 5/2018 | Fiebing | F04B 1/2092 |

* cited by examiner

*Primary Examiner* — Kenneth J Hansen
(74) *Attorney, Agent, or Firm* — Sterne, Kessler, Goldstein & Fox P.L.L.C.

(57) ABSTRACT

An axial piston machine is capable of suppressing a sudden change in hydraulic pressure in a piston oil chamber upon start and stop to enable the axial piston machine to start and stop smoothly. The axial piston machine includes: a cylinder block including a rotation axis and a plurality of piston oil chambers disposed around the rotation axis; pistons housed in the plurality of piston oil chambers, respectively; and orifices formed in the cylinder block that allow fluid communication between each of the piston oil chambers and an outside of the cylinder block. The orifices are positioned to be opened when the movable swash plate is in the neutral position and to be closed when the movable swash plate is in the operating position. The orifices are closed by outer peripheral surfaces of the pistons when the pistons approach a top dead center position.

6 Claims, 8 Drawing Sheets

AXIAL PISTON MACHINE AND METHOD OF EXTENDING NEUTRAL POSITION FOR AXIAL PISTON MACHINE

BACKGROUND

Field of the Invention

At least one embodiment of the present invention relates to an axial piston machine.

Background

A hydrostatic transmission (hereinafter referred to as an HST) in which a hydraulic pump and a hydraulic motor are fluidly connected to each other is known. Conventionally, in such a hydrostatic transmission, a rotational speed and a rotational direction of the motor can be changed by varying an angle of a movable swash plate of the variable displacement hydraulic pump, and the motor can be stopped by setting the swash plate in a neutral position. The hydrostatic transmission is used for driving a vehicle, for example. An axial piston machine equipped with a swash plate is used for each pump and motor constituting the HST. The swash plate is movable type on the pump side and fixed type on the motor side.

In the hydrostatic transmission having such a configuration, when an operating force is released while in a high speed rotating state, the movable swash plate suddenly returns to the neutral position, and hydraulic oil circulating smoothly in a closed circuit until then is blocked in the hydraulic pump. As a result, the rotation of the hydraulic motor abruptly stops, and a so-called dynamic brake is applied.

When the vehicle starts moving with the swash plate being in the neutral position, the hydraulic pressure, which is low, in the closed circuit suddenly rises, so that the vehicle suddenly starts to move, which may deteriorate a feeling upon the start of the vehicle.

Conventionally, as a countermeasure against the foregoing problems, a technique for extending a neutral region of the movable swash plate has been used in a hydrostatic transmission. For example, an internal damping system is used in U.S. Pat. No. 5,836,159 A. This internal damping system includes: a piston branched from an oil passage connecting a hydraulic pump and a hydraulic motor; and a hole through which hydraulic oil discharged by the piston is discharged to an oil sump in a housing, the system further including a swash plate body which has a groove for opening and closing the hole and is linked to the movable swash plate.

According to the internal damping system described above, an impact upon dynamic brake and upon starting an engine to move the vehicle forward or backward can be alleviated. However, this system causes a complex structure, and further, a space for this system is required.

SUMMARY

At least one embodiment of the present application provides an axial piston machine that can suppress a sudden change in hydraulic pressure in a piston oil chamber upon start and stop of the axial piston machine to enable the axial piston machine to smoothly start and stop, with a simple configuration in which an orifice is formed in a cylinder block.

In order to achieve the above-mentioned matters, an axial piston machine includes: a cylinder block including a rotation axis and a plurality of piston oil chambers disposed around the rotation axis; pistons housed in the plurality of piston oil chambers, respectively; a movable swash plate having a contact surface with which a head of each of the pistons contacts, the movable swash plate being freely changeable within a range from a neutral position where the contact surface is perpendicular to an axial direction of the pistons to inhibit the pistons from stroking to an operating position where the contact surface is inclined with respect to the axial direction of the pistons to allow the pistons to stroke; and orifices provided for the piston oil chambers of the cylinder block, respectively, for allowing communication between the piston oil chambers and an outside of the cylinder block, the orifices being positioned so as to be opened when the movable swash plate is in the neutral position and so as to be closed by outer peripheral surfaces of the pistons with approach of the pistons to a top dead center when the movable swash plate is in the operating position.

Further, in order to achieve the above-mentioned matters, the orifices are positioned lateral to distal ends of the pistons when the movable swash plate is in the neutral position.

Further, in order to achieve the above-mentioned matters, each of the pistons has a tapered portion that connects the distal end and the outer peripheral surface.

As described above, the orifices are provided for the piston oil chambers, respectively, and are positioned so as to be opened when the movable swash plate is in the neutral position and so as to be closed by outer peripheral surfaces of the pistons with approach of the pistons to a top dead center when the movable swash plate is in the operating position. This configuration can suppress a sudden change in hydraulic pressure in the piston oil chambers upon start and stop of the axial piston machine, thereby enabling the axial piston machine to start and stop smoothly.

These and other features and advantages will become apparent from the following detailed description of the invention with reference to the accompanying drawings.

BRIEF DESCRIPTION OF THE DRAWINGS

Hereinafter, some embodiments will be described with reference to the accompanying drawings, but the embodiments and the drawings are merely examples, and should not be construed in a limiting sense. In some drawings, the same elements are denoted with the same reference numerals.

DETAILED DESCRIPTION

A hydraulic pump in a hydraulic axle driving device will be described as an example of application of an axial piston machine.

In the following description, a front-rear direction, a left-right direction, and a top-bottom direction of the hydraulic axle driving device are defined as indicated by arrows in FIGS. 1 and 2.

Figure 1:
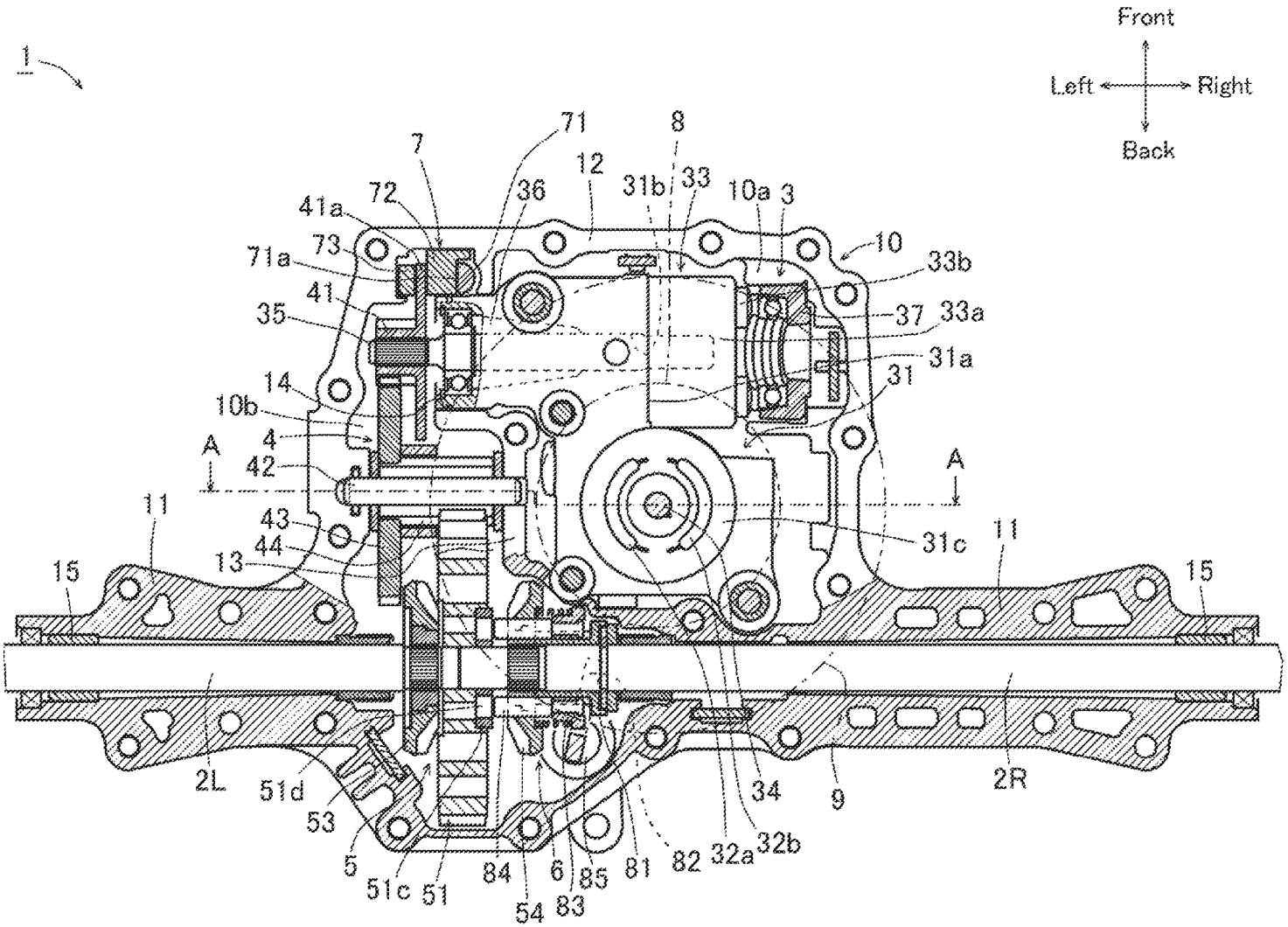
FIG. 1 is a partially sectional plan view of an axle driving device from which an upper housing is removed.
Figure 2:
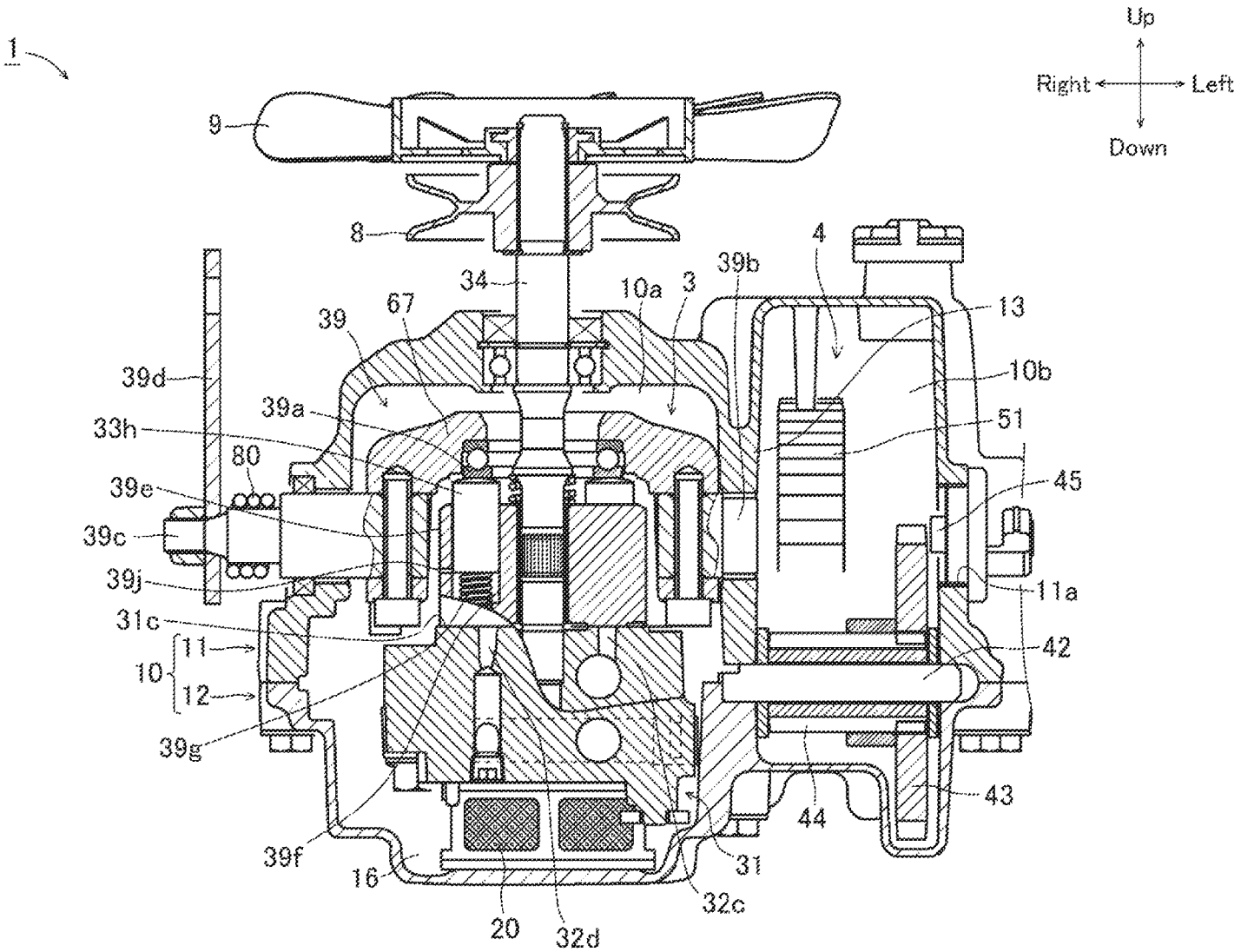
FIG. 2 is a partial sectional view of the axle driving device along line A-A in FIG. 1.

As illustrated in FIGS. 1 and 2, an axle driving device 1, which is an embodiment of the hydraulic axle driving device, has an axle drive case 10. The axle drive case 10 is constructed by fastening an upper housing 11 and a lower housing 12 with a plurality of bolts.

An HST chamber 10*a* and a gear chamber 10*b* are formed inside the axle drive case 10. An HST 3 is disposed in the HST chamber 10*a*, and a reduction gear train 4 and a differential gear unit 5 are disposed in the gear chamber 10*b*. The inside of the axle drive case 10 (that is, the HST chamber 10*a* and the gear chamber 10*b*) serves as an oil reservoir filled with oil (hydraulic oil) which is used for driving the HST 3 and lubricating the HST 3 and the reduction gear train 4. In the following description, a portion of the gear chamber 10*b* housing the reduction gear train 4 is arranged along the left side of the HST chamber 10*a* so as to extend forward beyond a portion of the gear chamber 10*b* housing the differential gear unit 5.

A right axle 2R extends to penetrate the upper housing 11, and is axially supported by a bush (needle bearing) 15 in an outer right end portion of the upper housing 11. A left axle 2L extends to penetrate the upper housing 11, and is axially supported by a bush 15 in the left end portion of the upper housing 11. The inner ends of the left and right axles 2L and 2R are disposed in the rear part of the gear chamber 10*b*. Specifically, the inner ends of the left and right axles 2L and 2R are fitted into an axial hole of a ring gear 51 of the differential gear unit 5 so as to face each other. The right axle 2R is disposed in the rear part of the gear chamber 10*b* while extending to the right from a gear mechanism in the differential gear unit 5, and extends in the left-right direction along the rear side of the HST chamber 10*a*.

The HST 3 has a center case 31, an axial piston type hydraulic pump 39 mounted to the center case 31, and an axial piston type hydraulic motor 33 mounted to the center case 31.

The center case 31 is disposed such that a right end thereof extends along the right side of the HST chamber 10*a*, a front end thereof is brought close to the front side of the HST chamber 10*a*, and a rear end thereof is brought close to the rear side of the HST chamber 10*a*. A horizontal surface 31*c* is formed in the rear half part of the center case 31, and the hydraulic pump 39 is attached to the horizontal surface 31*c* so as to extend above the rear half part of the center case 31.

A vertical pump shaft 34, which is the rotation axis of the hydraulic pump 39 (that is, an input shaft of the HST 3), extends upward with its lower part being axially supported within the rear half part of the center case 31, and an upper end of the pump shaft 34 projects upward beyond an upper end of the upper housing 11 of the axle drive case 10. An input pulley 8 and a cooling fan 9 are fixed to the upper end of the pump shaft 34. A belt (not shown) is wound around the input pulley 8, and the input pulley 8 is drivingly connected to a prime mover, such as an internal combustion engine, via the belt.

A cylinder block 39*e* is rotatably supported on the horizontal surface 31*c* to which the hydraulic pump 39 is mounted. Five pistons 33*h* are provided in five piston oil chambers 39*f* of the cylinder block 39*e* via neutral return springs 39*g* so as to be reciprocally movable. A pair of kidney ports 32*a* and 32*b* are opened in the horizontal surface 31*c*. The kidney ports 32*a* and 32*b* communicate with the piston oil chambers 39*f* when cylinder ports 39*k* formed at lower ends of the piston oil chambers 39*f* pass over the kidney ports 32*a* and 32*b*. In the present embodiment, the kidney port 32*a* is defined as a discharge side, and the kidney port 32*b* is defined as an intake side.

Heads 33*k* of the pistons 33*h* are in contact with a contact surface 39*m* of the movable swash plate 39*a*. The movable swash plate 39*a* is held by a swash plate body 67. The movable swash plate 39*a* is freely changeable within a range from a neutral position where the contact surface 39*m* is perpendicular to an axial direction of the pistons 33*h* to inhibit the pistons 33*h* from stroking to an operating position (for example, the positions illustrated in FIGS. 5 and 6) where the contact surface 39*m* is inclined with respect to the axial direction of the pistons 33*h* to allow the pistons 33*h* to stroke. FIG. 6 shows the maximum operating position of the movable swash plate 39*a*. Each piston 33*h* has a spherical head 33*k* and a tapered portion 33*j* connecting the lower end 33*m* serving as an example of a distal end and an outer peripheral surface. The hydraulic pump 39 is configured such that the pump shaft 34 is disposed vertically on the rotation axis of the cylinder block 39*e* and fixed to the cylinder block 39*e* so as to be relatively non-rotatable.

Next, a volume changing unit will be described. The volume changing unit is used for tilting the movable swash plate 39*a* to vary the discharge amount and discharge direction of the hydraulic oil with the hydraulic pump 39. As illustrated in FIG. 2, a first trunnion shaft 39*b* parallel to the axles 2L and 2R is rotatably supported on an intermediate wall 13 defining the HST chamber 10*a* and the gear chamber 10*b* of the upper housing 11, and a second trunnion shaft 39*c* extending to the outside of the axle drive case 10 in parallel with the axles 2L and 2R is rotatably supported on the right side wall of the upper housing 11. A control lever 39*d* is attached to an outer end of the second trunnion shaft 39*c*. The swash plate body 67 is attached to inner ends of the trunnion shafts 39*b* and 39*c* in the axle drive case 10. The control lever 39*d* is connected, via a link mechanism (not shown), to a speed change operating member (not shown), such as a lever or a pedal, provided in the vehicle.

When the control lever 39*d* is rotated in the volume changing unit including the movable swash plate 39*a*, the trunnion shafts 39*b* and 39*c*, and the swash plate body 67, the swash plate body 67 is rotated around the trunnion shafts 39*b* and 39*c*, by which the movable swash plate 39*a* is inclined. Thus, the discharge amount of the hydraulic oil from the hydraulic pump 39 can be varied.

The axle driving device 1 supporting the left and right axles 2L and 2R serving as an axle unit is configured to receive power from a prime mover (not shown) by means of the input pulley 8 provided on the pump shaft 34 and to output the received power to the left and right axles 2L and 2R via the HST 3, the reduction gear train 4, and the differential gear unit 5.

A vertical surface 31*a* serving as a receiving portion of the hydraulic motor 33 is formed in the front half part of the center case 31. The hydraulic motor 33 is attached to the vertical surface 31*a* so as to extend to the right beyond the front half part of the center case 31. A horizontal output shaft 35 which is the rotation axis of the hydraulic motor 33 (that is, the output shaft of the HST 3) is provided such that the right part thereof is axially supported in a shaft hole 31*b* formed in the front half part of the center case 31. The left part of the output shaft 35 is axially supported by a shaft support portion 36 which extends to the left beyond the front half part of the center case 31 and which serves as a receiving portion of the output shaft 35. The output shaft 35 of the hydraulic motor 33 extends toward the vertical surface 31*a* and toward the shaft support portion 36 in the center case 31.

A cylinder block 33*a* is rotatably supported on the vertical surface 31*a* to which the hydraulic motor 33 is mounted. A plurality of pistons 33*b* are placed in the plurality of piston oil chambers of the cylinder block 33*a* so as to be reciprocally movable via biasing springs. As in FIG. 3, a pair of kidney ports is opened to communicate with the piston oil chambers. Heads of the pistons 33*b* are in contact with a fixed swash plate 37. The fixed swash plate 37 is held between the upper housing 11 and the lower housing 12. The output shaft 35 is disposed horizontally on the rotation axis of the cylinder block 33*a* and fixed to the cylinder block 33*a* so as to be relatively non-rotatable. In this way, the hydraulic motor 33 is configured.

In the axle driving device 1, the HST 3 thus configured drives the hydraulic motor 33 with the discharged oil discharged by the hydraulic pump 39 driven by an engine (not shown), and controls the driving rotational speed and the rotational direction of the hydraulic motor 33 (output shaft 35) by reversely adjusting the angle of inclination and direction of the movable swash plate 39*a* of the hydraulic pump 39.

The axle driving device 1 is configured to be capable of self-suctioning oil in the oil reservoir into a closed circuit when the low-pressure side has a negative pressure due to leakage of the hydraulic oil flowing through the closed circuit in the HST 3. The axle driving device 1 is provided with an oil filter 20 for filtering the oil during self-suctioning. The lower part of the lower housing 12 of the axle driving device 1 serves as an oil sump 16 where the output shaft 35 of the hydraulic motor 33, the reduction gear train 4, and the HST 3 including the variable displacement type hydraulic pump 39 and the fixed displacement type hydraulic motor 33 which are fluidly connected via the closed circuit are housed.

The HST 3 in the axle drive case 10 is formed by fluidly connecting the kidney ports 32*a* and 32*b* of the hydraulic pump 39 and the kidney ports of the hydraulic motor 33 by a pair of oil passages 32*c* and 32*d*.

The reduction gear train 4 disposed in the gear chamber 10*b* includes a motor output gear 41, a counter shaft 42, a large diameter counter gear 43, a small diameter counter gear 44, and a ring gear 51 which also serves as an input gear of the differential gear unit 5. The motor output gear 41 is fixed to the left end of the output shaft 35 in the gear chamber 10*b*. The counter shaft 42 extends horizontally in the left-right direction and is disposed in the gear chamber 10*b* between the output shaft 35 in front of the counter shaft 42 and the differential gear unit 5 disposed behind the counter shaft 42.

The small diameter counter gear 44 is mounted on the counter shaft 42 so as to extend along the counter shaft 42 between the left and right sides in the middle of the gear chamber 10*b* in the front-rear direction, and a rear end of the small diameter counter gear 44 is meshed with the ring gear 51. The large diameter counter gear 43 is fixed to the small diameter counter gear 44, and the front end of the large diameter counter gear 43 meshes with the motor output gear 41. In this way, the reduction gear train 4 is configured to transmit power from the output shaft 35 to the ring gear 51 via the motor output gear 41, the large diameter counter gear 43, and the small diameter counter gear 44.

A rotation sensor 45 is disposed on the left side of the large diameter counter gear 43 in the reduction gear train 4. The rotation sensor 45 is an electromagnetic pickup sensor capable of detecting a rotational direction. The rotation sensor 45 is mounted by using a hole 11*a* which is formed in the left side surface of the upper housing 11 covering the gear chamber 10*b* for processing a support hole for the second trunnion shaft 39*c*. The rotation sensor 45 detects the rotational direction of the large diameter counter gear 43 for detecting whether the axle driving device 1 is in a forward movement state or in a backward movement state.

A brake device 7 for braking the output shaft 35 is disposed within the front end part of the gear chamber 10*b*. In association with this, the motor output gear 41 is formed with a flange as a brake disc 41*a*. The brake device 7 includes a vertical camshaft 71, a brake shoe 72, and a brake pad 73.

The camshaft 71 is pivotally supported by the axle drive case 10, and the upper part thereof projects upward from the axle drive case 10. Meanwhile, in the gear chamber 10*b*, the camshaft 71 is formed with a semicircular cross-sectional portion having a vertical cam face 71*a*. The cam face 71*a* faces the brake shoe 72 disposed between the camshaft 71 and the front end of the brake disc 41*a*.

The brake pad 73 is attached to the wall of the axle drive case 10, and the front end of the brake disc 41*a* is located between the brake shoe 72 and the brake pad 73. Normally, the camshaft 71 is positioned in the rotational direction so as to be in a non-braking position where the cam face 71*a* extends parallel to the brake shoe 72 as illustrated in FIG. 1, and with this, the brake disc 41*a* is separated from the brake shoe 72 and the brake pad 73, and the rotation of the output shaft 35 is maintained in a state where the brake is not applied.

The differential gear unit 5 includes the ring gear 51, two pinion gears (not shown), a first side gear 53, and a second side gear 54. The ring gear 51 has a plate 51*c* in which an insertion hole is formed. The plate 51*c* receives a differential lock mechanism 6.

The pinion gears are bevel gears, and are housed in the ring gear 51. The first side gear 53 is a bevel gear that is disposed on the left side surface, which is one of the side surfaces of the ring gear 51, so as to be spline fitted to the left axle 2L. The first side gear 53 meshes with the two pinion gears.

The second side gear 54 is a bevel gear that is disposed on the right side surface, which is the other side surface of the ring gear 51, so as to be spline fitted to the right axle 2R. The second side gear 54 meshes with the two pinion gears.

According to the differential gear unit 5 thus configured, it is possible to differentially rotate the left axle 2L and the right axle 2R.

The differential lock mechanism 6 is configured by combining a differential lock slider 81, a differential lock fork 82, and a spring 83. Here, the plate 51*c* of the ring gear 51 is formed with a recess 51*d* into which a differential lock pin 84 is to be inserted. A differential lock pin 84 protrudes from the side of the differential lock slider 81 facing the ring gear 51 so as to correspond to the recess 51*d*.

The differential lock fork 82 rotates with the rotation of a rotary shaft 85, and due to the rotation of the differential lock fork 82, the differential lock slider 81 is switched between a differential lock position near the left axle 2L and a differential lock release position near the right axle 2R. The differential lock slider 81 is constantly urged in the direction of the differential lock release position by the spring 83. When the rotary shaft 85 is rotated against the spring force of the spring 83 by a driver, the differential lock slider 81 moves to the differential lock position where the differential lock pin 84 is inserted into the recess 51*d*. In this way, the differential lock mechanism 6 can be operated.

Figure 3:
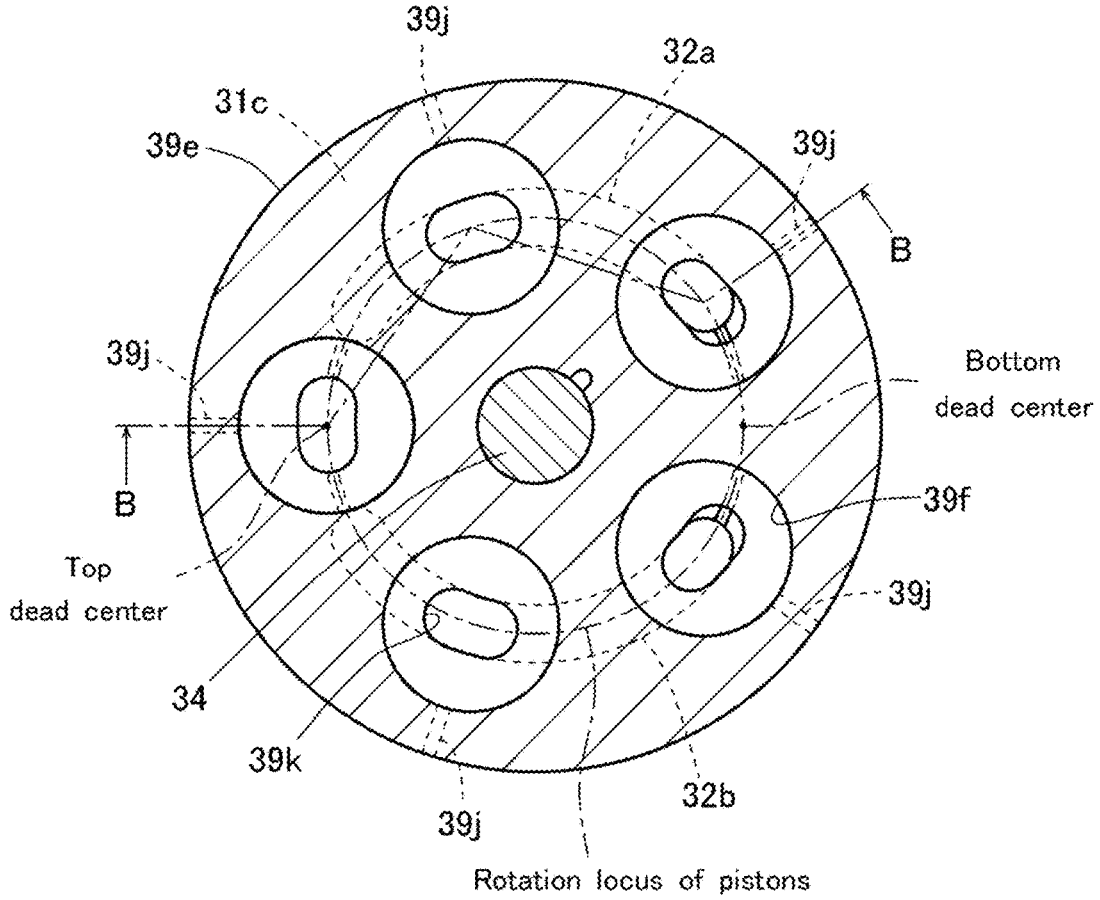
FIG. 3 is a plan view of a cylinder block and a horizontal surface.
Figure 4A:
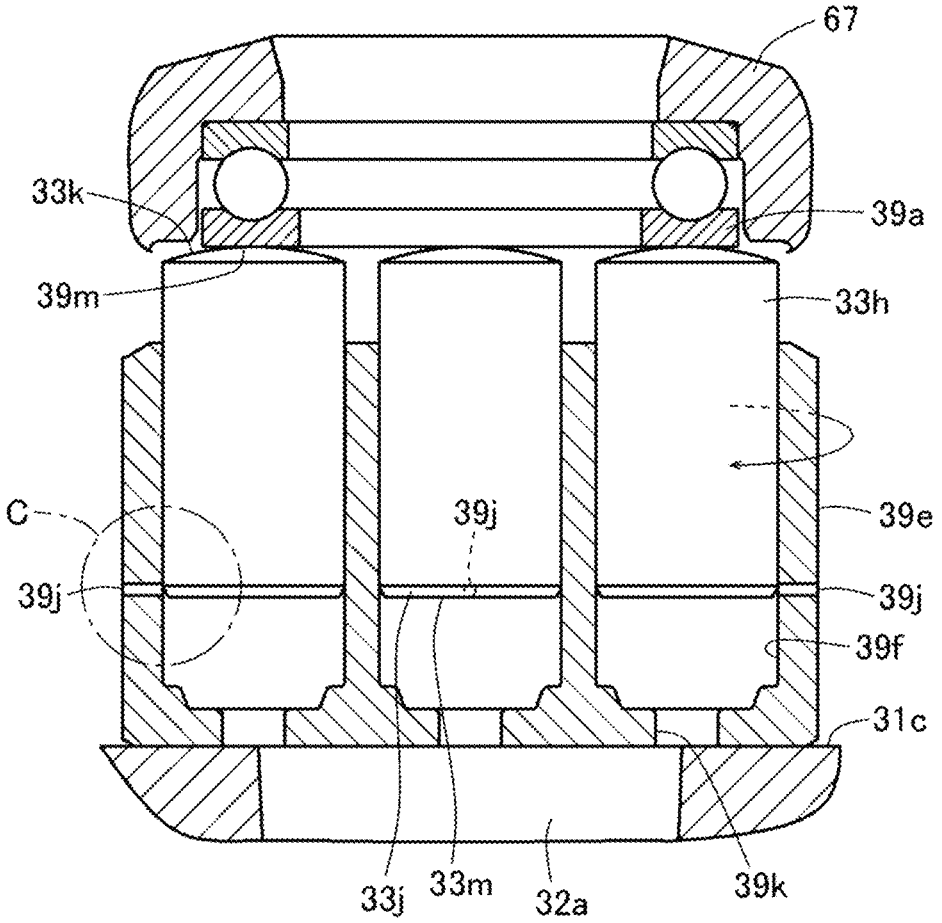
FIG. 4A is a sectional view along line B-B in FIG. 3 when a hydraulic pump is in a neutral position.
Figure 4B:
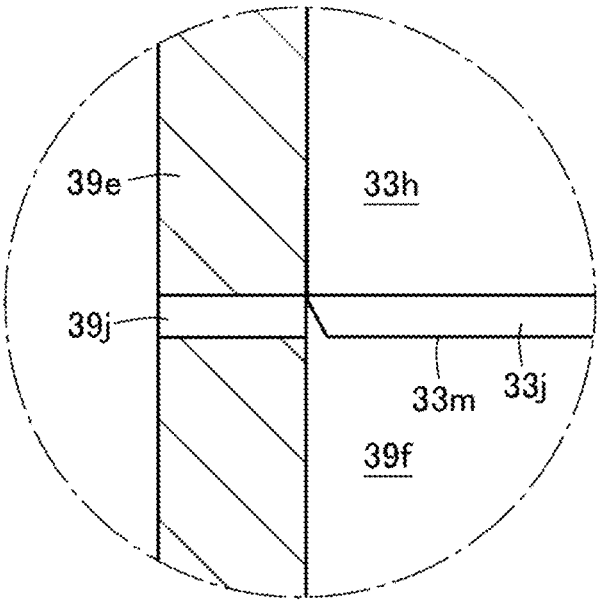
FIG. 4B is an enlarged view of a region C in FIG. 4A.
Figure 5:
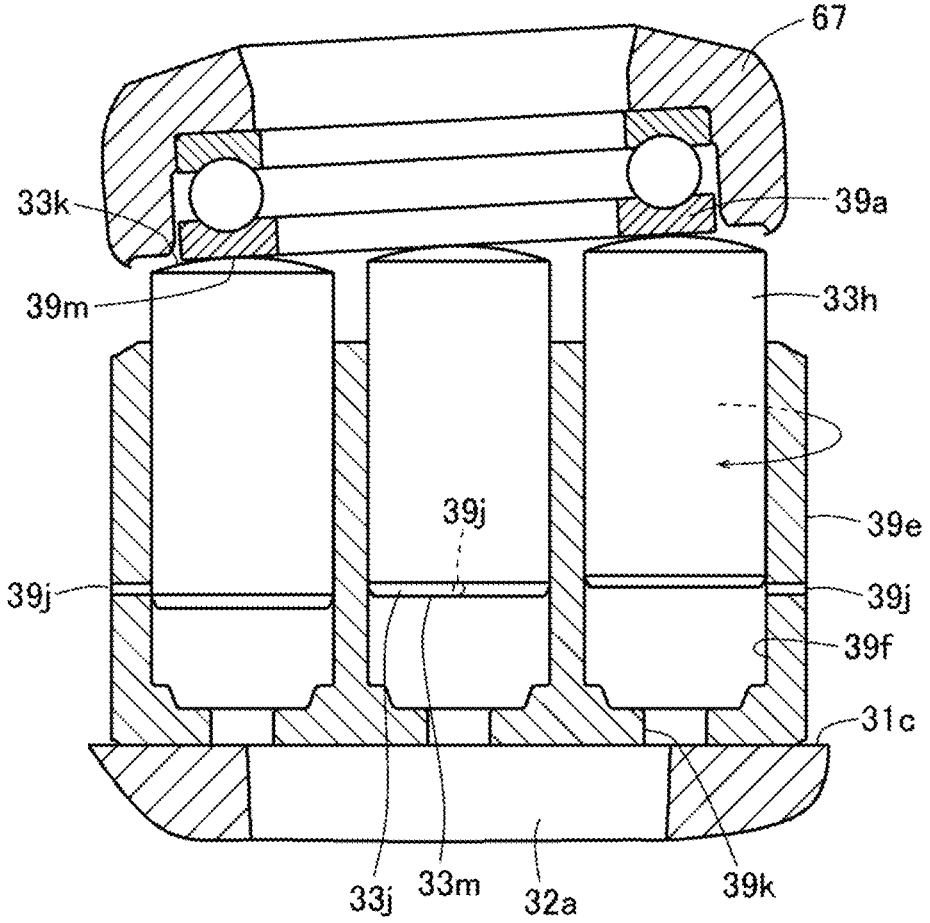
FIG. 5 is a sectional view along the line B-B in FIG. 3 when a movable swash plate of the hydraulic pump is positioned between the neutral position and a maximum operating position on one side (forward side).
Figure 6:
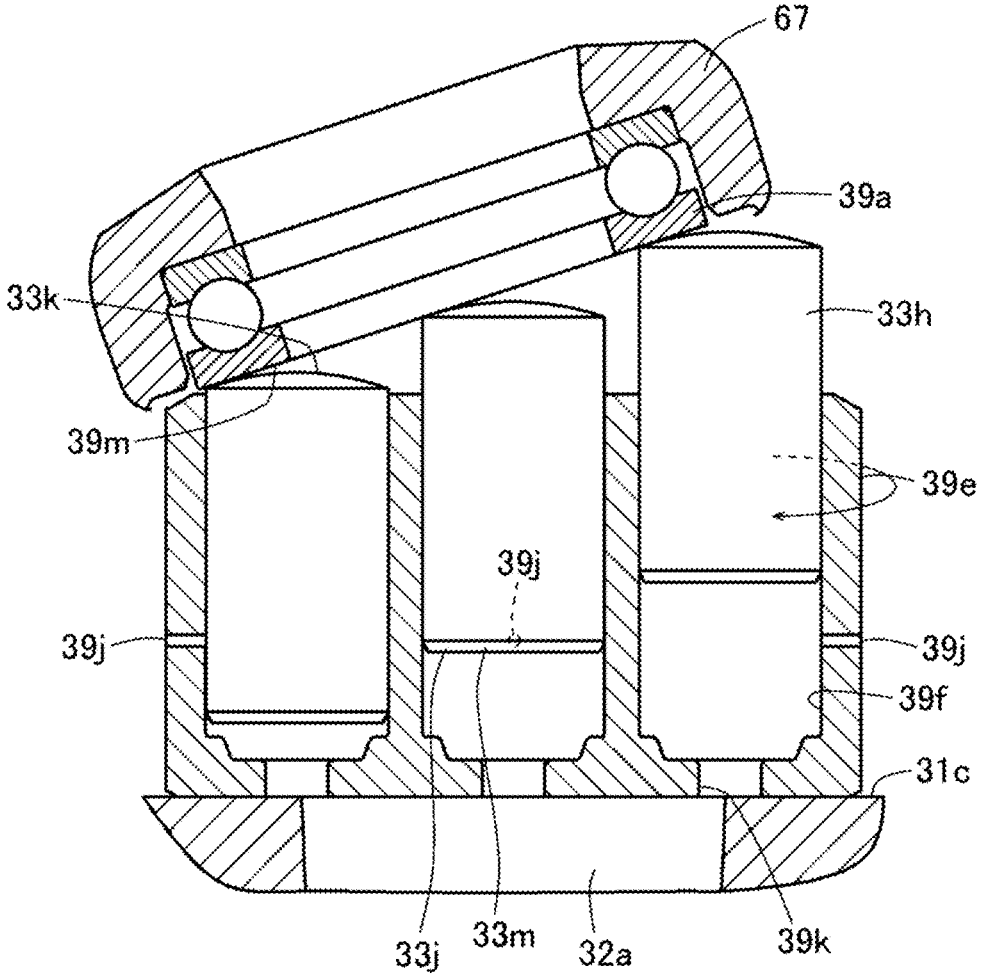
FIG. 6 is a sectional view along the line B-B in FIG. 3 when the movable swash plate of the hydraulic pump is in the maximum operating position on one side (forward side).
Figure 7:
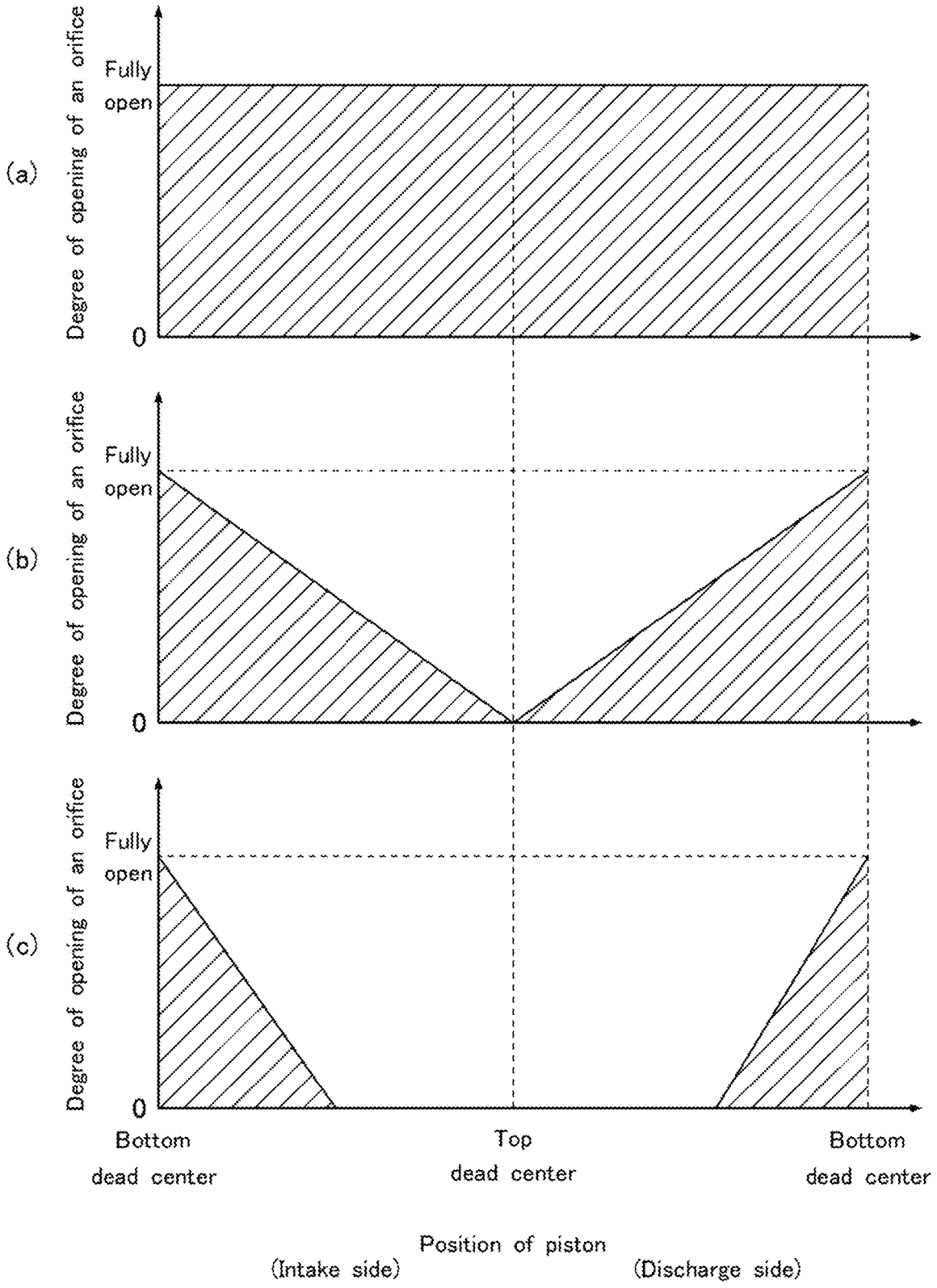
FIG. 7 are graphs showing that the degree of opening of an orifice communicating with one piston oil chamber varies according to an angle of the movable swash plate per rotation of the cylinder block.

FIG. 3 is a plan view of the cylinder block 39*e* and the horizontal surface 31*c*, and FIGS. 4A, 5 and 6 are sectional views of the hydraulic pump 39 along the line B-B in FIG. 3. FIGS. 4A and 4B show a state where the movable swash plate 39*a* and the pistons 33*h* are in the neutral position, FIG. 5 shows a state where the movable swash plate 39*a* is positioned between the neutral position and the maximum operating position on one side (forward side), and FIG. 6 shows a state where the movable swash plate 39*a* is at the maximum operating position on one side (forward side). The neutral return springs 39*g* are not illustrated in FIGS. 4 to 6. FIG. 4B is an enlarged view of a region C in FIG. 4A. FIG. 7 are graphs showing that the degree of opening of an orifice 39*j* communicating with one piston oil chamber 39*f* varies according to an angle of the movable swash plate 39*a* per rotation of the cylinder block 39*e*.

The orifices 39*j* are formed in the cylinder block 39*e* so as to correspond to the piston oil chambers 39*f*, respectively. The orifices 39*j* are positioned so as to be opened when the movable swash plate 39*a* is in the neutral position and so as to be closed by outer peripheral surfaces of the pistons 33*h* with approach of the pistons 33*h* to the top dead center when the movable swash plate 39*a* is in the operating position. In the present embodiment, the orifice 39*j* is positioned lateral or adjacent to the lower end 33*m*, more specifically, lateral or adjacent to the tapered portion 33*j*, of each piston 33*h* which is in the neutral position, as shown in FIGS. 4A and 4B. That is to say, orifice 39*j* is at the same axial height as lower end 33*m* with respect to the axis of piston oil chamber 39*f* when pistons 33*h* are in a neutral position. When the piston 33*h* is in the neutral position, the piston oil chamber 39*f* communicates with the outside or exterior of the cylinder block 39*e* due to the orifice 39*j*.

In one rotation of the cylinder block 39*e*, an intake process is performed during a half rotation where the pistons 33*h* move in the piston oil chambers 39*f* from the top dead center (where the pistons are pushed down (compressed) to the lowest position) to a bottom dead center (where the pistons are extended to the highest position), and a discharge process is performed during the other half rotation where the pistons 33*h* move in the piston oil chambers 39*f* from the bottom dead center to the top dead center. In this embodiment, the position of the leftmost piston 33*h* is the top dead center and the position of the rightmost piston 33*h* is the bottom dead center in FIG. 6, for example.

While the cylinder ports 39*k* communicate with the kidney port 32*b*, serving as the intake side, during the half rotation where the pistons 33*h* move from the top dead center to the bottom dead center, the intake process is performed for suctioning the hydraulic oil into the piston oil chambers 39*f* via the kidney port 32*b*. On the other hand, while the cylinder ports 39*k* communicate with the kidney port 32*a*, serving as the discharge side, during the half rotation where the pistons 33*h* move from the bottom dead center to the top dead center, the discharge process is performed for discharging the hydraulic oil suctioned into the piston oil chambers 39*f* from the kidney port 32*a* under pressure. Due to the reciprocal movement of each piston 33*h* in the piston oil chamber 39*f* with the rotation of the cylinder block 39*e*, the intake process and the discharge process are repeated to achieve pumping. To vary the discharge amount of the hydraulic oil from the pump, the movable swash plate 39*a* is inclined at a required angle by the control lever 39*d*, so that the displacement capacity in each piston oil chamber 39*f* is adjusted according to the inclination angle, and the discharge amount of the hydraulic oil discharged from the kidney port 32*a* serving as the discharge side is variably controlled.

The cross-sectional shape of each orifice 39*j* is not particularly limited, and it may be circular, elliptical, or polygonal, for example. In the present embodiment, it is circular. In addition, each orifice 39*j* may have any cross-sectional area that allows the hydraulic oil in the piston oil chamber 39*f* to flow, and the cross-sectional area is appropriately designed so as to achieve a desired flow rate.

Next, the operation of the orifices 39*j* in the hydraulic pump 39 being driven will be described with reference to FIGS. 4A to 6. In the state illustrated in FIG. 4A, the cylinder block 39*e* is rotating due to the rotation of the pump shaft 34, and the pistons 33*h* are stopped at the neutral position by the movable swash plate 39*a* which is in the neutral position. That is, the vehicle is stopped. At this time, the hydraulic oil in the piston oil chambers 39*f* can be discharged to the oil reservoir outside the cylinder block 39*e* through the orifices 39*j*, and the degree of opening of each of the orifices 39*j* is fully open as illustrated in FIG. 7(*a*).

When the speed change operating member of the vehicle is operated slightly in the forward direction in the state illustrated in FIG. 4A, the movable swash plate 39*a* is slightly inclined via the control lever 39*d* to be in the state illustrated in FIG. 5, and the stroke of the pistons 33*h* is started. At this time, the piston oil chambers 39*f* communicate with the oil reservoir through the orifices 39*j* at the position (bottom dead center) of the rightmost piston 33*h* moving over the kidney port 32*a* serving as the discharge side and at the position of the central piston 33*h* in FIG. 5, whereas the piston oil chamber 39*f* and the oil reservoir are not in communication with each other at the position (top dead center) of the leftmost piston 33*h* in FIG. 5.

Therefore, a portion of the hydraulic oil, which is to flow through the kidney port 32*a*, in the piston oil chambers 39*f* is discharged to the oil reservoir via the orifices 39*j*, so that the vehicle does not start moving and the neutral region is increased. At this time, as shown in FIG. 7(*b*), the degree of opening of each of the orifices 39*j* gradually decreases to 0 as the pistons 33*h* move from the bottom dead center to the top dead center, and gradually increases as the pistons 33*h* move from the top dead center to the bottom dead center.

When the speed change operating member of the vehicle is operated in the maximum operation amount from the state in FIG. 5, the movable swash plate 39*a* is inclined to the maximum operating position, and the state shown in FIG. 6 is obtained. At this time, the piston oil chambers 39*f* communicate with the oil reservoir through the orifices 39*j* at the position (bottom dead center) of the rightmost piston 33*h* and at the position of the central piston 33*h* shown in FIG. 6, whereas the piston oil chamber 39*f* and the outside of the cylinder block 39*e* are not in communication with each other at the position (top dead center) of the leftmost piston 33*h* in FIG. 6.

Therefore, a portion of the hydraulic oil in the piston oil chambers 39*f* is discharged to the outside of the cylinder block 39*e* through the orifices 39*j*, whereby a sudden change in hydraulic pressure in the piston oil chamber 39*f* is suppressed, and the hydraulic motor 33 operates smoothly. Therefore, even when the speed change operating member is rapidly operated, the vehicle accelerates smoothly. At this time, as shown in FIG. 7(*c*), the degree of opening of each of the orifices 39*j* gradually decreases to 0 while the pistons 33*h* move from the bottom dead center to the top dead center, and gradually increases while the pistons 33*h* move to the bottom dead center from the top dead center.

When the driver stops operating the speed change operating member of the vehicle in the state shown in FIG. 6, the state of FIG. 4A is obtained through the state of FIG. 5 due to the action of the neutral return springs 39*g* and the hydraulic reaction force acting on the movable swash plate 39*a*, and thus, the stroke of the pistons 33*h* stops. That is, the vehicle stops. At this time, the piston oil chambers 39*f* also communicate with the oil reservoir outside the cylinder block 39*e* through the orifices 39*j* as described above with reference to FIGS. 4A and 5, whereby a sudden change in hydraulic pressure in the piston oil chambers 39*f* is suppressed, and the hydraulic motor 33 smoothly stops. Therefore, the vehicle stops smoothly.

As described above, the orifices 39*j* are positioned so as to be opened when the movable swash plate 39*a* is in the neutral position and so as to be closed by the outer peripheral surfaces of the pistons 33*h* with approach of the pistons 33*h* from the bottom dead center to the top dead center when the movable swash plate 39*a* is in the operating position. This configuration can suppress a sudden change in hydraulic pressure in the piston oil chambers 39*f* upon start and stop of the hydraulic motor 33, thereby enabling the hydraulic motor 33 to start and stop smoothly. In addition, the orifices 39*j* do not always open the piston oil chambers 39*f*, but are closed by the outer peripheral surfaces of the pistons 33*h* near the top dead center, so that the neutral region is increased without deteriorating the operation efficiency of the hydraulic pump 39. Therefore, an occurrence of creeping upon stopping the vehicle can be suppressed.

Furthermore, with the configuration in which each orifice 39*j* is positioned lateral to the lower end 33*m* of each piston 33*h* which is in the neutral position as in the above embodiment, smooth start and stop can be achieved and the neutral region can be decreased, whereby an energy loss can be suppressed. Further, each piston 33*h* has the tapered portion 33*j*. Accordingly, when the piston 33*h* moves toward the top dead center, the orifice 39*j* is not rapidly opened or closed but gradually opened or closed as the tapered portion 33*j* moves past the lateral side of the orifice 39*j*. Therefore, a change in the flow rate of the hydraulic oil discharged through the orifice 39*j* becomes gentle, and thus, the hydraulic motor 33 operates more smoothly.

In addition, the configuration using the orifices 39*j* can provide a simplified structure with fewer parts than the conventional configuration using the internal damping system, can reduce cost, and can reduce the installation space. The result of an experiment using passenger lawn mowers as the vehicles indicates that the vehicle using the orifices 39*j* opened on the outer peripheral surface of the cylinder block 39*e* in place of an internal damping system provides a driving feeling almost equal to a driving feeling provided by the vehicle using the internal damping system, and provides less noise, such as "whining sound" and "growl", than the vehicle using the internal damping system. In addition, when the vehicle using the orifices 39*j* has been stopped on a 17° slope without applying a brake, the wheels rotated slowly to the same extent as the vehicle using the internal damping system, and therefore, it is considered that the vehicle using the orifices 39*j* has no problem regarding freewheeling.

In the above embodiment, the hydraulic axle driving device in which the output shaft of the hydraulic motor is disposed perpendicular to the input shaft of the hydraulic pump has been described as an example of application of the axial piston machine. However, the example of application is not limited thereto. For example, the axial piston machine may be applied to a hydraulic axle driving device in which an output shaft of a hydraulic motor is oriented obliquely with respect to an input shaft of a hydraulic pump. Alternatively, for example, the axial piston machine may be applied to a hydraulic axle driving device in which a hydraulic motor disposed at a place distant from a hydraulic pump is connected to the hydraulic pump by pipes. Further, the number of the pistons 33*h* may be five or seven.

A method of using embodiments of this disclosure for extending neutral position for an axial piston machine in an engine includes allowing oil to flow between plurality of piston oil chambers 39*f* disposed in cylinder block 39*e* and an exterior of cylinder block 39*e* through plurality of orifices 39*j* when movable swash plate 39*a* is in a neutral position. When movable swash plate 39*a* is in an operating position and piston 33*h* disposed in each of plurality of piston oil chambers 39*f* approaches a top dead center position, the oil is blocked from flowing between plurality of piston oil chambers 39*f* disposed in cylinder block 39*e* and an exterior of cylinder block 39*e*. The blocking of the flow through orifice 39*j* is accomplished by translating each of the plurality of pistons 33*h* to a position approaching top dead center such that the outer peripheral surface of each of pistons 33*h* blocks orifice 39*j*.

The above description relates to specific embodiments of the present invention, and various modifications are possible without departing from the spirit of the present invention. The appended claims are intended to cover such applications within the true scope and spirit of the present invention.

Accordingly, the embodiments described in this application are to be considered as illustrative and not to be considered as restrictive. The scope of the present invention is to be expressed in the following claims rather than the above description, and it should be construed that the scope of the present invention covers various modifications within the scope and spirit of the claims and their equivalents.

What is claimed is:

1. An axial piston machine, comprising:

a cylinder block including a rotation axis and a plurality of piston oil chambers disposed around the rotation axis, the cylinder block having a plurality of cylinder ports, each cylinder port formed in each one of the piston oil chambers;

pistons housed in the plurality of piston oil chambers, respectively;

a movable swash plate having a contact surface with which a head of each of the pistons contacts, the movable swash plate being freely changeable within a range from a neutral position where the contact surface is perpendicular to an axial direction of the pistons to inhibit the pistons from stroking to an operating position where the contact surface is inclined with respect to the axial direction of the pistons to allow the pistons to stroke; and orifices formed in the cylinder block for allowing communication between each of the piston oil chambers and an exterior of the cylinder block, the orifices being positioned so as to be opened when the movable swash plate is in the neutral position and so as to be closed by outer peripheral surfaces of the pistons when the pistons approach a top dead center position when the movable swash plate is in the operating position.

2. The axial piston machine according to claim 1, wherein the orifices are positioned adjacent to distal ends of the pistons when the movable swash plate is in the neutral position.

3. The axial piston machine according to claim 2, wherein each of the pistons has a tapered portion that connects the distal end and the outer peripheral surface.

4. The axial piston machine of claim 3, wherein the tapered portion is configured to extend a transition between each orifice being closed by the outer peripheral surface and each orifice being open.

5. A method of extending neutral position for an axial piston machine in an engine, the method comprising:

allowing oil to flow between a plurality of piston oil chambers disposed in a cylinder block and an exterior of the cylinder block through a plurality of orifices when a movable swash plate is in a neutral position, the cylinder block having a plurality of cylinder ports, each cylinder port formed in each one of the piston oil chambers; and blocking oil from flowing between the plurality of piston oil chambers disposed in the cylinder block and the exterior of the cylinder block through the plurality of orifices when a movable swash plate is in an operating position and a piston disposed in each of the plurality of piston oil chambers approaches a top dead center position, wherein the blocking of the flow through the plurality of orifices is accomplished by translating each of the pistons to a position approaching the top dead center position such that an outer peripheral surface of each of the pistons blocks each of the orifices.

6. The method of extending neutral position for an axial piston machine in an engine of claim 5, further comprising:

transitioning from allowing oil to flow through the plurality of orifices to blocking oil from flowing through the plurality of orifices by moving tapered portions past each of the orifices, wherein the tapered portions are disposed between the outer peripheral surfaces and a distal end of each of the pistons.

* * * * *